United States Patent [19]

Yoshikawa et al.

[11] Patent Number: 4,889,036

[45] Date of Patent: Dec. 26, 1989

[54] SPEED REDUCER FOR PNEUMATIC ACTUATOR

[75] Inventors: Akihisa Yoshikawa; Masamichi Tajima; Watanabe Kunio; Toshiharu Sato, all of Soka, Japan

[73] Assignee: SMC Corporation, Tokyo, Japan

[21] Appl. No.: 199,958

[22] Filed: May 27, 1988

[30] Foreign Application Priority Data

May 30, 1987 [JP] Japan ..... 62-137105

[51] Int. Cl.[4] ..... F15B 15/22

[52] U.S. Cl. ..... 91/403; 91/404; 91/419

[58] Field of Search ..... 91/393, 403, 404, 405, 91/419, 397, 398, 1, 459, 275, 361

[56] References Cited.

U.S. PATENT DOCUMENTS

| | | | |
|---|---|---|---|
| 3,363,514 | 1/1968 | Ramcke | 91/405 X |
| 3,370,428 | 2/1968 | Van Deberg | 91/405 X |
| 4,033,235 | 7/1977 | Berg | 91/405 X |
| 4,132,153 | 1/1979 | Grotness et al. | 91/405 |

FOREIGN PATENT DOCUMENTS

| | | | |
|---|---|---|---|
| 2908583 | 9/1980 | Fed. Rep. of Germany | 91/405 |
| 393071 | 2/1974 | U.S.S.R. | 91/404 |

*Primary Examiner*—Robert E. Garrett
*Assistant Examiner*—Mark A. Williamson
*Attorney, Agent, or Firm*—Oblon, Spivak, McClelland, Maier & Neustadt

[57] ABSTRACT

A speed-reducing valve assembly is provided in an air passage through which compressed air is discharged when a pneumatic actuator is decelerated. The speed-reducing valve assembly comprises a three-way valve actuated by a signal generated when the actuator has reached the point where deceleration is started, a relief valve through which the compressed air in the passage is let out when the air pressure has reached the preset level, and a check valve that allows only the admission of compressed air into the same passage. The signal-actuated three-way valve brings the air passage of the actuator into communication with the passage in which the relief valve and check valve are provided. When the signal generated when the actuator has reached the deceleration starting point is fed to the speed-reducing valve assembly, the exhaust passage of the actuator communicates with the relief valve and check valve. If the pressure in the actuator is lower than the desired level, the check valve opens to introduce a fluid of the desired pressure through the pressure-reducing valve. If the inside pressure is higher, the air is discharged through the relief valve. Thus the pressure in the exhaust-side pressure chamber of the actuator is always maintained at the desired level. The piston of the actuator is therefore rapidly and smoothly brought to a stop at the desired point.

7 Claims, 2 Drawing Sheets

SPEED REDUCER FOR PNEUMATIC ACTUATOR

FIELD OF THE INVENTION

This invention relates speed reducers for use in softly stopping a pneumatic actuator at the end of its stroke.

DESCRIPTION OF THE PRIOR ART

For the increase of productivity, the operating speed of actuator and their air cylinders have been increased, resulting in an increase in the impace force exerted at the end of the stroke. Being too large to absorb with cushion mechanisms of the conventional type contained in the cylinder, the kinetic energy arising from their motion is absorbed by shock absorbers or other damping means added to the air cylinder.

But such conventionally used speed reducing means involve several problems. Mechanical systems exerting a frictional braking force on the piston rod, for example, generates heat of friction and brings about an unwanted temperature increase in the whole unit. Even hydraulic systems using noncompressive liquids produce heat through internal friction, causing such cavitation as will lower the shock-absorbing ability. Therefore, such systems are unsuitable for cylinders operated at high speed and frequency Another type of system achieves speed reduction by releasing the cylinder air through an orifice. But the need to narrow down the normally opened passage for deceleration takes a considerable time between the start and completion of deceleration. In addition, the speed is not reduced to zero on completion of deceleration.

Peripheral speed reducing means are difficult to add to existing actuators with no cushioning mechanism. To add such speed reducing function, such existing actuators must be replaced with appropriate ones.

OBJECTS OF THE INVENTION

A main object of this invention is to provide a speed reducer for a pneumatic actuator that effectively serves a speed reducing function with the addition of simple means to an existing actuator.

Another object of this invention is to provide a speed reducer for a pneumatic actuator that withstands frequent uses involving high speeds without generating heat of friction in deceleration.

Still another object of this invention is to provide a speed reducer for a pneumatic actuator adapted to be used in any of the high-speed heavy-load, high-speed low-load and low-speed heavy-load modes by constantly keeping the pressure at the exhaust end of the actuator at the preset level.

Yet another object of this invention is to provide a speed reducer for a pneumatic actuator that achieves smooth deceleration in a short time, without going through a time-consuming deceleration process encountered in a conventional speed reducing system of the type that releases air in the actuator through an orifice.

SUMMARY OF THE INVENTION

In order to achieve the above objects, the speed reducer of this invention comprises a speed-reducing valve assembly provided in an air passage from which air is released for decelerating a pneumatic actuator that is connected to a source of compressed air through a change-over valve. The speed-reducing valve assembly comprises a three-way valve that is switched by a decelerating signal issued when the actuator reaches the point where deceleration begins, a relief valve that releases the compressed air in the passage when the fluid pressure reaches the preset level and a check valve that allows only the inflow of compressed air into the passage in which the relief valve is provided. The three-way valve actuated by the decelerating signal switches the air flow in the actuator from the passage leading to the outside through the changeover valve to the passage in which the relief valve and check valve are provided. The inlet side of the check valve is connected with a pressure-reducing valve to feed the fluid from the compressed-air source after lowering the pressure of the fluid to the preset level.

When the actuator moves and a signal generated at the deceleration starting point reaches the speed reducing valve, the exhaust passage of the actuator communicates with the relief valve and check valve. If the pressure in the actuator is lower than the preset level, the check valve is opened to admit the fluid of the preset pressure level through the speed reducing valve. If the pressure in the actuator is higher, the fluid is released through the relief valve. Thus, the pressure in the pressure chamber at the exhaust end of the actuator is constantly kept at the preset level. With the pressure in the actuator thus controlled, the piston is rapidly and smoothly brought to a stop at the desired point.

DESCRIPTION OF THE PREFERRED EMBODIMENTS

Figure 1:
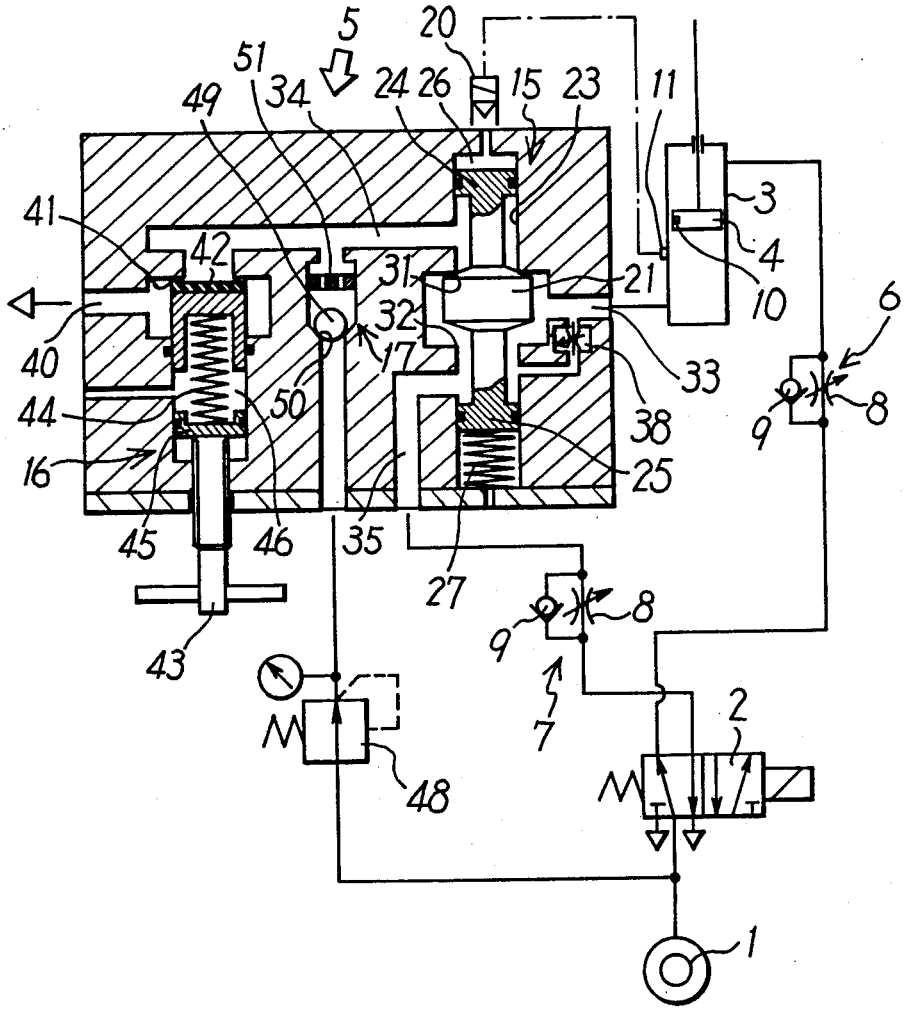
FIG. 1 is a cross-sectional view of a first preferred embodiment of this invention.

A first preferred embodiment of this invention shown in FIG. 1 essentially comprises a speed reducing valve assembly 5 provided in one of the passages of an air cylinder 3 connected to a source of compressed air 1 through a 5-way solenoid valve 2. In this embodiment, the speed reducing valve 5 is connected to the head-side passage of the cylinder 3.

The changeover valve 2 switches the moving direction of the piston 4 in the cylinder 3. The compressed air supplied through the changeover valve 2 is sent to one of the pressure chambers in the air cylinder 3 through a speed controller 6 or 7 which comprises a variable orifice 8 and a check valve 9 connected in parallel. Meanwhile, the compressed air from the other pressure chamber is discharged into the atmosphere through the speed controller 7 or 6 and the changeover valve 2. The air cylinder 3 is driven by the inflow and outflow of the compressed air. While compressed air is admitted through the check valve 9 and variable orifice 8 in the speed controller 6 or 7 on the inlet side, it is released through the variable orifice 8 alone, with the check valve 9 closed, on the outlet side.

The air cylinder 3 is equipped with a signal generating means that issues an electrical or pneumatic signal to start deceleration when the piston reaches the given point of the stroke. The generated signal is sent to the speed reducing valve 5. The signal generating means in the illustrated embodiment detects the position of the moving piston 4 by means of a sensor 11 mounted on the outside of the cylinder 3 that detects the approach of a magnet 10 provided in the piston 4 as a change in the magnetic field. Other known methods can be employed too, such as a limit switch that is adapted to be actuated at the signal generating point by means of a tappet attached to the piston rod or the like.

The speed-reducing valve assembly 5 comprises a three-way valve 15 actuated by the signal described above and a relief valve 16 and a check valve 17 that are brought into communication with the cylinder 3 through the three-way valve 15 when the signal is generated.

The three-way valve 15 has a valve actuating mechanism 20 operated by the signal from the signal generating means to switch the position of the valve body 21. For example, a pilot valve may be used as the valve actuating mechanism 20. On both sides of the valve body 21 are provided sliding projections 24 and 25 guided along the valve bore 23. A pilot pressure chamber 26 defined by the sliding projection 24 is connected to the outlet of the pilot valve, with provisions made for a return spring 27 to exert force on the outer end of the other sliding projection 25.

The valve body 21 brings a passage 33 leading to the head-side pressure chamber in the cylinder 3 into communication with a passage 34 leading to the relief valve 16 and check valve 17 by opening a valve seat 31 and closing a valve seat 32. It brings the passage 33 into communication with a passage 35 leading to the speed controller 7 by closing the valve seat 31 and opening the valve seat 32. When the signal-driven valve-actuating mechanism 20 switches the position of the valve body 21, the passage 33 leading to the cylinder 3 is switched from the passage 35 to the passage 34. When the valve-actuating mechanism 20 is released, the force exerted by the return spring 27 brings the passage 33 back into communication with the passage 35.

A variable orifice 38 provided in a bypass passage through which the passage 33 communicates with the passage 35 permits the pressurized fluid remaining in the head-side pressure chamber of the cylinder 3, passage 33, etc. at the end of the stroke to flow out into the passage 35.

The relief valve 16 provided at the farthest end of the passage 34 has a valve seat 41 positioned between the passage 34 and a relief port 40 opening into the atmosphere and a relief valve body 42 adapted to come in and out of contact with the valve seat 41. An external adjusting bolt 43 compresses a setting spring 44 interposed between a spring seat 45 and the valve body 42, thereby permitting the adjustment of the relief setting pressure.

A setting spring chamber 46 containing the setting spring 44 of the relief valve 16 opens into the atmosphere.

The check valve 17 feeds the fluid of reduced pressure into the passage 34 through a pressure-reducing valve 48 that lowers the pressure of the fluid from the source of compressed air 1 to the given level. There is a valve chamber that contains a ball 49. A valve seat 50 with which the ball 49 comes in and out of contact is provided on the pressure-reducing valve side of the valve chamber. A perforated wall 51 is provided on the side of the passage 34 to prevent the slip off of the ball 49. This provision allows only the inflow of compressed air into the passage 34 leading to the relief valve 16, blocking the outflow of compressed air from the passage 34.

In the air cylinder speed reducer of the configuration just described, the piston 4 is driven downward when the changeover valve 2 is switched to the illustrated position. The sensor 11 generates a signal when the piston 4 reaches the given point in its stroke. When the signal is sent to the valve-actuating mechanism 20 of the speed-reducing valve 5, the valve body 21 cuts off the changeover valve 2 from the head-side pressure chamber of the air cylinder 3, thus bringing the same pressure chamber into communication with the relief valve 16. If the pressure in the head-side pressure chamber of the air cylinder 3 is lower than the level needed for the weakening of the impact force, the check valve 17 opens to raise the pressure to the desired level by admitting a fluid of the preset level. If the pressure inside is higher than the desired level and has become higher with the movement of the piston in the cylinder, the relief valve 16 opens to let out the over-pressurized fluid to regain the desired pressure level in the cylinder 3.

Since the pressure in the air cylinder 3 thus controlled, the piston therein moves rapidly and quietly to the predetermined point. After the piston has reached the end of its stroke, the feeding of signal to the valve-actuating mechanism 20 of the speed-reducing valve assembly 5 is cut off. The signal can be cut off in an appropriate fashion, such as on sensing the arrival of the piston at the end of its stroke or when a given time has passed after the startup of the valve-actuating mechanism 20.

When the signal is no longer fed to the valve-actuating mechanism 20, the passage 33 leading to the air cylinder 3 is cut off from the passage 34, whereas the air cylinder 3 and the changeover valve 2 are brought into communication through the passages 33 and 35 to let out the residual fluid in the air cylinder 3.

Figure 2:
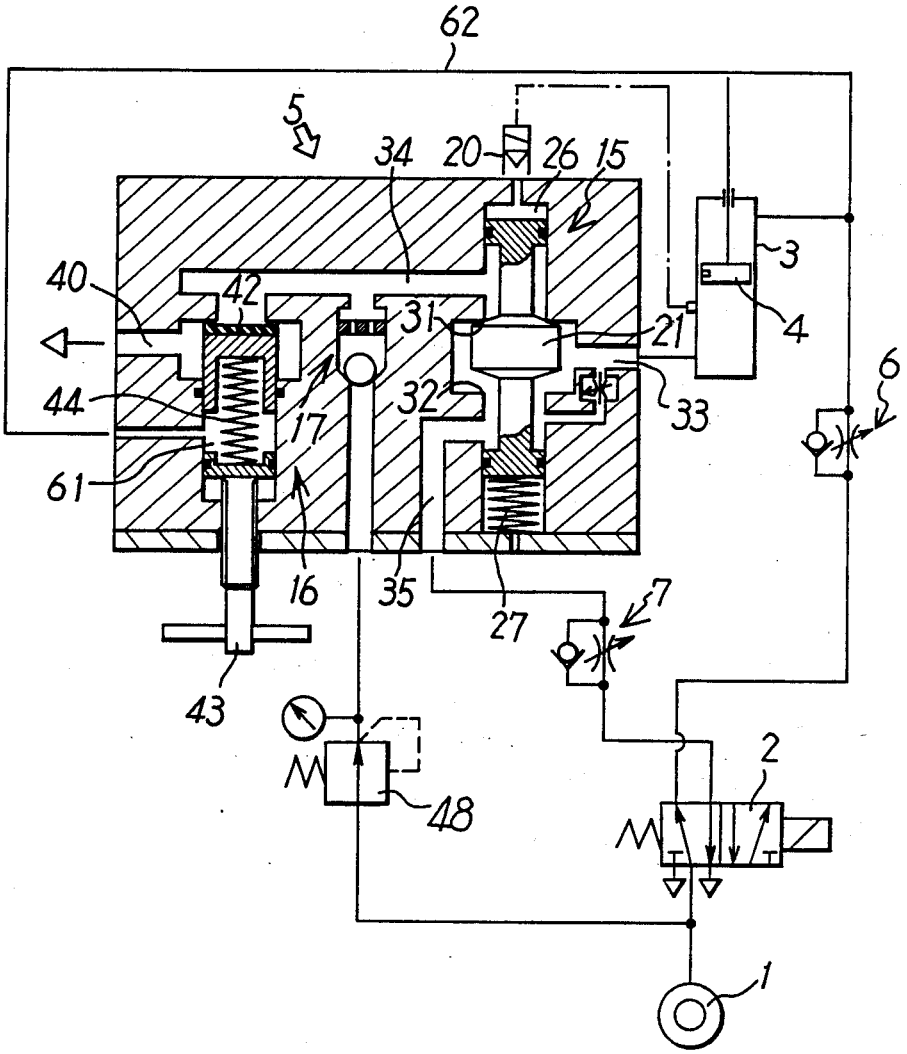
FIG. 2 is a cross-sectional view of a second preferred embodiment of this invention.

A second preferred embodiment shown in FIG. 2 is similar to the first embodiment except in the point described herebelow. Therefore, the same or analogous parts are designated by the same reference characters.

The main difference between the two embodiments lies in that the pressurized fluid in the pressure chamber (e.g., the rod-side chamber) opposite to the pressure chamber (e.g., the head-side chamber) of the air cylinder 3 is introduced through a passage 62 into a setting spring chamber 61 of the relief valve 16 in the speed-reducing valve assembly 5 to build up a back pressure acting against the relief valve body 42.

This arrangement increases the shock-absorbing ability as described below. Generally, the pressure in the supply-side (i.e., rod-side) pressure chamber increases as the piston is decelerated, resulting in a drop in the shock-absorbing ability. In the second preferred embodiment, therefore, the shock-absorbing ability is increased by applying a bias corresponding to the increased pressure on the capacity of the relief valve 16.

This provision permits decreasing not only the load on the setting spring of the relief valve but also the size of the whole unit.

The air bias system shown in FIG. 2 contributes, at the sacrifice of increased piping, to the increasing of the shock-absorbing ability that might be damaged when the pressure in the air cylinder increases under the high-speed heavy-load, low-speed heavy-load and some other operating conditions and also to the size reduction of not only the speed-reducing valve itself but also the whole speed reducer.

The speed reducers for air cylinders just described constantly keep the pressure in the cylinder at the desired level by introducing a fluid of the desired pressure level through the check valve 17 when the pressure in the air cylinder is lower than the preset level and discharging the over-pressurized fluid through the relief valve 16 when the pressure inside is higher. As a consequence, the piston is allowed to come to a stop at the desired point through rapid and smooth deceleration. The speed reducers of this invention can withstand frequent uses because the heat produced in the process of deceleration is much less than in the mechanical friction-driven speed reducers. The speed reducers of this invention consist of a small number of component parts, such as the speed-reducing valve assembly 5 provided in the fluid passage, that can be readily attached to existing cushionless actuators.

In the illustrated preferred embodiments, the speed-reducing valve assembly 5 is provided on the head side of the air cylinder 3. But the speed-reducing valve assembly 5 may be provided on both or either of the rod and head sides of the air cylinder 3. Not only the illustrated air cylinder but also a rotary actuator may be used as the actuator.

What is claimed is:

1. A speed reducer for pneumatic actuators which comprises a pneumatic actuator connected to a source of compressed air through a changeover valve and a speed-reducing valve assembly connected to an air passage through which compressed air is discharged when the pneumatic actuator is decelerated:

the speed-reducing valve assembly comprising:

a three-way valve actuated by a decelerating signal issued when the actuator has reached the point where deceleration is to be started;

a relief valve that lets out the compressed air in the passage at a preset relief pressure level; and a check valve that allows only the admission of compressed air into a passage leading to said relief valve;

the signal-actuated three-way valve switches the air passage in the actuator from a passage leading to the atmosphere through the changeover valve to the passage in which the relief valve and check valve are provided;

the check valve being connected to a pressure-reducing valve through which the fluid from the source of compressed air is supplied after lowering the fluid pressure to the desired level.

2. A speed reducer for pneumatic actuators which comprises a pneumatic actuator connected to a source of compressed air through a changeover valve and a speed-reducing valve assembly connected to an air passage through which compressed air is discharged when the pneumatic actuator is decelerated:

the speed-reducing valve assembly comprising:

a three-way valve actuated by a decelerating signal issued when the actuator has reached the point where deceleration is to be started;

a relief valve that lets out the compressed air in the passage at a preset relief pressure level; and a check valve that allows only the admission of compressed air into a passage leading to said relief valve;

the signal-actuated three-way valve switches the air passage in the actuator from a passage leading to the atmosphere through the changeover valve to the passage in which the relief valve and check valve are provided;

the check valve being connected to a pressure-reducing valve through which the fluid from the source of compressed air is supplied after lowering the fluid pressure to the desired level;

the pressure in a pressure chamber opposite to a pressure chamber used for the pressure control of the actuator is introduced as a back pressure acting against the motion of the relief valve.

3. A speed reducer for pneumatic actuators according to claims 1 or 2, in which the pneumatic actuator consists of an air cylinder with a pneumatically driven piston.

4. A speed reducer for pneumatic actuators according to claim 3, including a signal generating means for generating said decelerating signal, said signal generating means comprising an external sensor mounted on the cylinder that detects the approach of a magnet provided in the piston as a change in the magnetic field.

5. A speed reducer for pneumatic actuators according to claims 1 or 2, in which a variable orifice and a check valve are disposed in parallel in the passage that connects the pneumatic actuator to the source of compressed air through a changeover valve.

6. A speed reducer for pneumatic actuators according to claims 1 or 2, in which the three-way valve has a valve body whose position is switched by a pilot valve actuated by the signal from the signal generating means.

7. A speed reducer for pneumatic actuators according to claims 1 or 2, in which the relief valve has a relief valve body and the pressure applied by a pressure setting spring on the relief valve body is adjusted by means of an external adjustment bolt.

* * * * *